United States Patent [19]

Ikejima et al.

[11] Patent Number: 4,984,660

[45] Date of Patent: Jan. 15, 1991

[54] APPARATUS FOR CONTROLLING AN ELEVATOR

[75] Inventors: Satomi Ikejima; Shigemi Iwata, both of Inazawa, Japan

[73] Assignee: Mitsubishi Kenki Kabushiki Kaisha, Japan

[21] Appl. No.: 338,219

[22] Filed: Apr. 14, 1989

[30] Foreign Application Priority Data

Apr. 15, 1988 [JP] Japan ..... 63-92752

[51] Int. Cl.[5] ..... B66B 3/02

[52] U.S. Cl. ..... 187/134

[58] Field of Search ..... 187/116, 134

[56] References Cited

U.S. PATENT DOCUMENTS 4,039,049 8/1977 Yoneda et al. ..... 187/134 X
4,233,588 11/1980 Satoh ..... 187/134
4,735,295 4/1988 Hochstrasser et al. ..... 187/134
4,880,082 11/1989 Kahkipuro et al. ..... 187/134

FOREIGN PATENT DOCUMENTS 57-27877 2/1982 Japan .

*Primary Examiner*—A. D. Pellinen
*Assistant Examiner*—W. E. Duncanson, Jr.
*Attorney, Agent, or Firm*—Leydig, Voit & Mayer

[57] ABSTRACT

An apparatus for controlling an elevator adds cage moving distances per unit time by advance position calculating means at predetermined time to a reference value in parallel with the running operation of the elevator, corrects the moving distance by advance position correcting means in accordance with plate position information at the time of detecting the plate disposed in an elevator shaft in a position corresponding to a floor, and then compares the actually moved distance with the plate position information stored in a memory to obtain a cage advance floor.

8 Claims, 5 Drawing Sheets

APPARATUS FOR CONTROLLING AN ELEVATOR

BACKGROUND OF THE INVENTION

The present invention relates to an apparatus for controlling an elevator and, more particularly, to an apparatus for determining a floor at which an elevator cage can be stopped.

FIG. 6 is a diagram for explaining a method of determining a floor at which an elevator cage can be stopped (hereinafter referred to as an "advance floor") to detect a call of a cage in a cage call selector disclosed, for example, in Japanese Published Unexamined Patent Application No. 57-27877. In the prior art, the advance floor is determined in accordance with interfloor codes produced by encoding interfloor distances and floor detection signals output when a detection switch (limit switch) on a cage engages with cams corresponding to floors provided in an elevator shaft.

More particularly, the advance floor according to a prior-art apparatus is determined two times: immediately after the start and a while after the start. In the former case, time codes are employed, it is determined whether full speed operation is possible by a method to be described later, and, if possible, the advance floor immediately after the start (after 1 sec.) is used as a full speed operation enabling floor. In the latter case, the advance floor is updated by information that a cage has passed cams disposed at the respective floors in the elevator shaft.

A method of determining whether full speed operation is possible will now be described.

In the design of an elevator, the running speed of the cage is preferably set at a value suitable for the running distance. Therefore, the cage is run at a speed lower than a rated speed (hereinafter referred to as a "partial speed") if the running distance is less than a full speed runnable distance corresponding to the rated speed.

In order to determine whether the operating mode should be full speed running or partial speed running, interfloor codes produced by encoding interfloor distances are stored in a read-only memory (ROM), it is detected from which floor a cage starts and at which floor the cage is to be stopped, and whether or not the cage can run at a full speed is judged according to the interfloor code.

The interfloor code is determined as follows in a elevator having, for example, a rated speed of 105 m/min. and a full speed runnable distance of approximately 6000 mm.

When the interfloor distance is less than 3000 mm: interfloor code="00"

When the interfloor distance is more than 3000 mm and less than 6000 mm: interfloor code="01"

When the interfloor distance is more than 6000 mm: interfloor code="02".

Based on the above-described interfloor codes, the operating mode becomes full speed running under the following conditions.

During one-floor operation when an interfloor code is "02",

During two-floor operation when the sum of the interfloor codes is "02" or more, and During operation over three or more floors (regardless of the interfloor code).

The cage is run at partial speed under all other conditions.

Since the conventional elevator system is constructed as described above, the following problems arise.

(1) Since the operating mode is selected according to the interfloor code, the optimum operating mode is not always selected. One such situation is in an elevator having a rated speed of 105 m/min. in a building having an interfloor distance of 3500 mm between the first and second floors and an interfloor distance of 2700 mm between the second and third floors when the cage is run from the first floor to the third floor. In this case, the distance from the first floor to the third floor is 6200 mm which is greater than the full speed runnable distance. However, since the interfloor codes are respectively "01" and "00", the condition that the sum of the interfloor codes is "02" or more in two floor operation is not satisfied. Thus, the cage can be run only at partial speed irrespective of the full speed runnable distance, so the operating efficiency is decreased.

(2) Since the number of floors and interfloor distances naturally differ from building to building, the interfloor codes to be written in the ROM are different. Thus, ROMs having different contents must be prepared for each building at the time of installing an elevator, complicated labor is required, and modifications are not easy.

(3) Since the cams provided at the respective floors in an elevator shaft are required only for calculating the advance floor and cannot be utilized for other purposes, the economic efficiency is deteriorated, and the installation of the cams requires much labor.

SUMMARY OF THE INVENTION

The present invention has been made in view of the disadvantages described above, and has for its object to provide an apparatus for controlling an elevator which has a simple arrangement and can calculate an advance floor and provide the optimum operating mode for the running distance of a cage.

BRIEF DESCRIPTION OF THE DRAWINGS

In the drawings, the same symbols indicate the same or corresponding parts.

DESCRIPTION OF THE PREFERRED EMBODIMENTS

Figure 1:
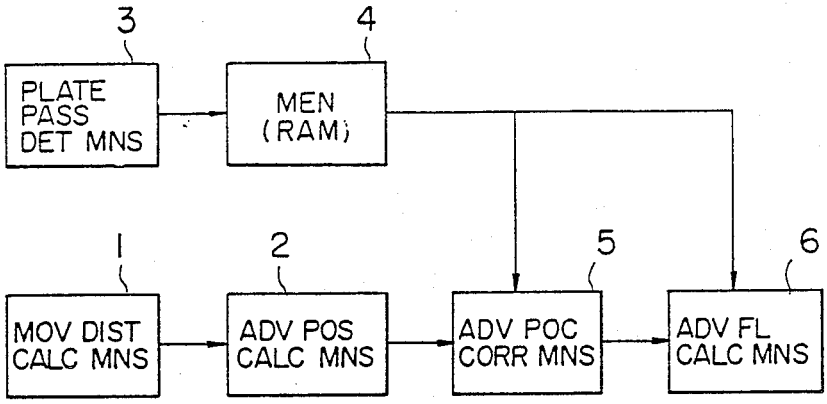
FIG. 1 is a block diagram of an apparatus for controlling an elevator according to an embodiment of the present invention.

FIG. 1 shows the entire arrangement of an embodiment of an apparatus for controlling an elevator according to the present invention. In the drawing, reference numeral 1 denotes time-dependent increment calculating means for calculating a time-dependent increment $\Delta A$ in response to a cage running state (whether during acceleration or constant speed running), numeral 2 denotes advance position calculating means for adding the time-dependent increments ΔA at predetermined intervals (calculating period) to an advance position ADV, which is a reference value, to calculate a time-dependent cage advance position, numeral 3 denotes plate passage detecting means for outputting plate passage information when a cage has passed a plate corresponding to a floor along an elevator shaft, numeral 4 denotes a memory (hereinafter referred to as a "RAM") for reading plate position information from the memory in accordance with plate passage information, numeral 5 denotes advance position correcting means for correcting the time-dependent advance position to an actual advance position in accordance with the plate position information, and numeral 6 denotes advance floor calculating means for calculating a cage advance floor from the actual advance position and the plate position information.

Figure 2:
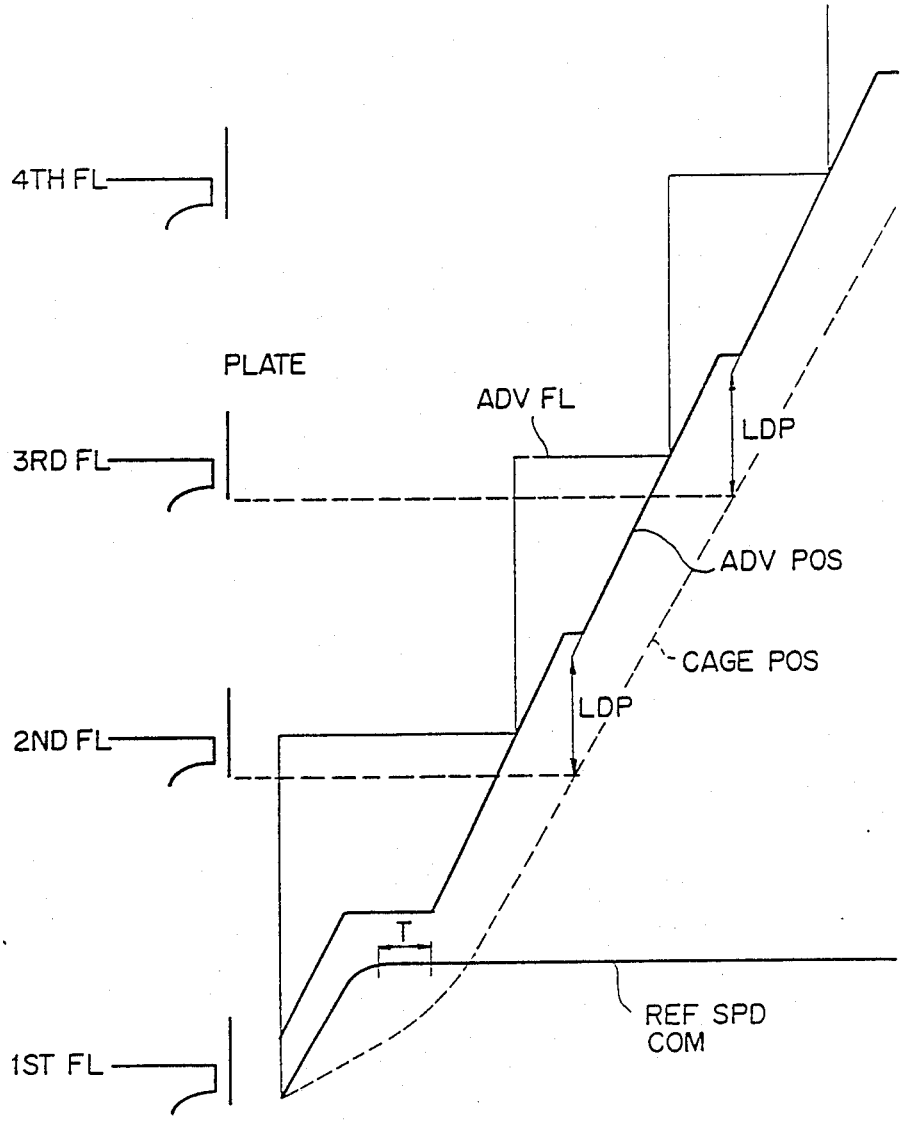
FIG. 2 is a diagram showing the relationship among a cage position, an advance position, and an advance floor.

FIG. 2 is a view showing the relationship among the position at which a cage can be stopped, the floor at which the cage can be stopped, and the cage position in this embodiment. As is apparent from FIG. 2, the position at which the cage can be stopped (the advance position) must be always advanced from the cage position. Thus, the position at which the cage can be stopped is calculated by the advance position calculating means 2.

Since it is necessary to correct the position at which the cage can be stopped in accordance with the actual operation of the cage, cage position information is required. Thus, the position at which the cage can be stopped is normally corrected by position information read from the memory 4 by a plate passage signal output when a position detector installed in the cage engages with a plate corresponding to each floor. Each plate is disposed in an elevator shaft and is used for detecting a zone in which a door can be opened or a level position.

The operating point of the position detector for the plate of each floor is provided by running the cage from the lowermost floor to the uppermost floor and storing the value of the position of each plate in the RAM 4 as disclosed in Japanese Patent Application No. 59-48852.

For an N-floor building:

FPU(l), FPU(2) ... ... ... , FPU(N) ---
Position of upper end of each plate
FPD(l), FPD(2) ... ... ... , FPD(N) ---
Position of lower end of each plate The remaining distance to the floor at which the cage is to be stopped and a reference speed command signal corresponding to the remaining distance are generated in accordance with the positions of the respective floors stored in the RAM 4.

The time-dependent advance position obtained by the advance position calculating means 2 is always so advanced from the actual cage advance position that the cage can be positioned under any condition, regardless of the cage load, the running direction, and the like.

The time-dependent advance position is then corrected in accordance with position information by the plate and the position detector. In other words, when the fact that the cage has passed a plate is detected by the plate passage detecting means 3, the advance position is corrected by the advance position correcting means 5 in accordance with the position of the plate stored in the RAM 4.

The calculation of the advance position by the advance position calculating means 2 will now be described, where ADV denotes the advance position and ΔA denotes a time-dependent increment obtained by the moving distance calculating means 1.

Since the time-dependent increments ΔA are different during acceleration of the cage and during predetermined running after the end of acceleration, it is necessary to obtain them by separate methods.

(1) During acceleration

The cage must arrive at the advance position to be able to run at a full speed at the time that acceleration ends. Accordingly, ΔA is obtained as below so that the cage arrives at the position to run at full speed at the time that acceleration ends.

Figure 3:
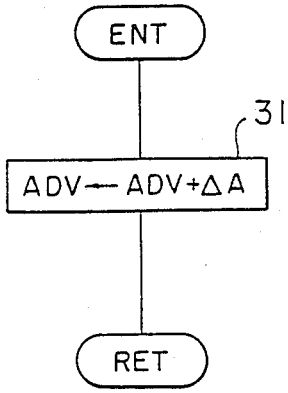
FIG. 3 is a flow chart showing a method of calculating an advance position.

ΔA=(Distance necessary to run at full speed)/(time from start to end of acceleration)×calculating period This ΔA is added to the time-dependent increment ADV (which is given an initial value of "0") each calculating period (FIG. 3).

(2) During predetermined running

The distance moved by the cage at a rated speed at each calculating period during running is represented by rated speed×calculating period.

The actual speed of the elevator cage varies according to its load. For example, when the cage is running upwards with no load, $$\text{Actual speed} = \text{rated speed} + \alpha_1 \ (\alpha_1 > 0)$$

When the cage is running upwards with a full load, $$\text{Actual speed} = \text{rated speed} - \alpha_2 \ (\alpha_2 > 0)$$

Thus, the distance moved by the cage when running upwards with no load becomes larger than "rated speed×calculating period". On the contrary, when the cage is running upwards with a full load, the distance moved by the cage becomes smaller than that.

Therefore, a margin e is provided in the time-dependent increment ΔA by considering the variation in the actual speed due to the load such that the advance position is always actually advanced from the position at which the cage can be stopped.

$$\Delta A = \text{rated speed} \times \text{calculating period} + \alpha (\alpha > 0)$$

is added each calculating period in the same manner as described in paragraph (1). Thus, the calculated distance moved by the cage is the integral of the rated speed with respect to time plus a margin.

Switching from (1) during acceleration to (2) during predetermined running of the cage is performed after a predetermined time T has elapsed from when the cage starts running at a predetermined speed by considering the reference speed command value and the delay T of the actual speed of the cage (FIG. 2).

Here, since the time-dependent increment ΔA in (2) during predetermined running of the cage includes a margin, the advance position is advanced as the cage runs with respect to the position at which the cage can be stopped. This causes a deterioration in the service of the elevator. Namely, the elevator will not respond to a passenger's stop request for a floor at which the cage can actually be stopped, since it will judge that it is already impossible for the cage to stop at the floor.

Therefore, the excessively advanced position is corrected by the advance position correcting means 5 during predetermined running so as not to cause a deterioration in service. This correction is executed by utilizing the plate position output from the memory 4, which receives a passage signal output from the plate passage detecting means 3.

The advance position obtained as a function of time in the manner described above will be denoted as ADV1.

Assume now that the cage has passed the plate on the Kth floor.

The plate positions of the respective floors are

FPU(1), FPU(2) ... ... ... , FPU(N) --- Upper ends of plates, and

FPD(1), FPD(2) ... ... ... , FPD(N) --- Lower ends of plates

From these values, the position of the lower end of the plate on the Kth floor FPD(K) is extracted. The advance position of the cage measured from position FPD(K) is calculated as FPD(K)+LDP, wherein LDP is the decelerating distance from full speed. The sum FPD(K)+LDP will be denoted as ADV2.

$$(ADV2 \rightarrow FPD(K)+LDP)$$

The advance position is corrected in accordance with ADV2. However, ADV is set equal to the maximum of (ADV1, ADV2) so that the advance position ADV will not be smaller than in the previous period.

Figure 4:
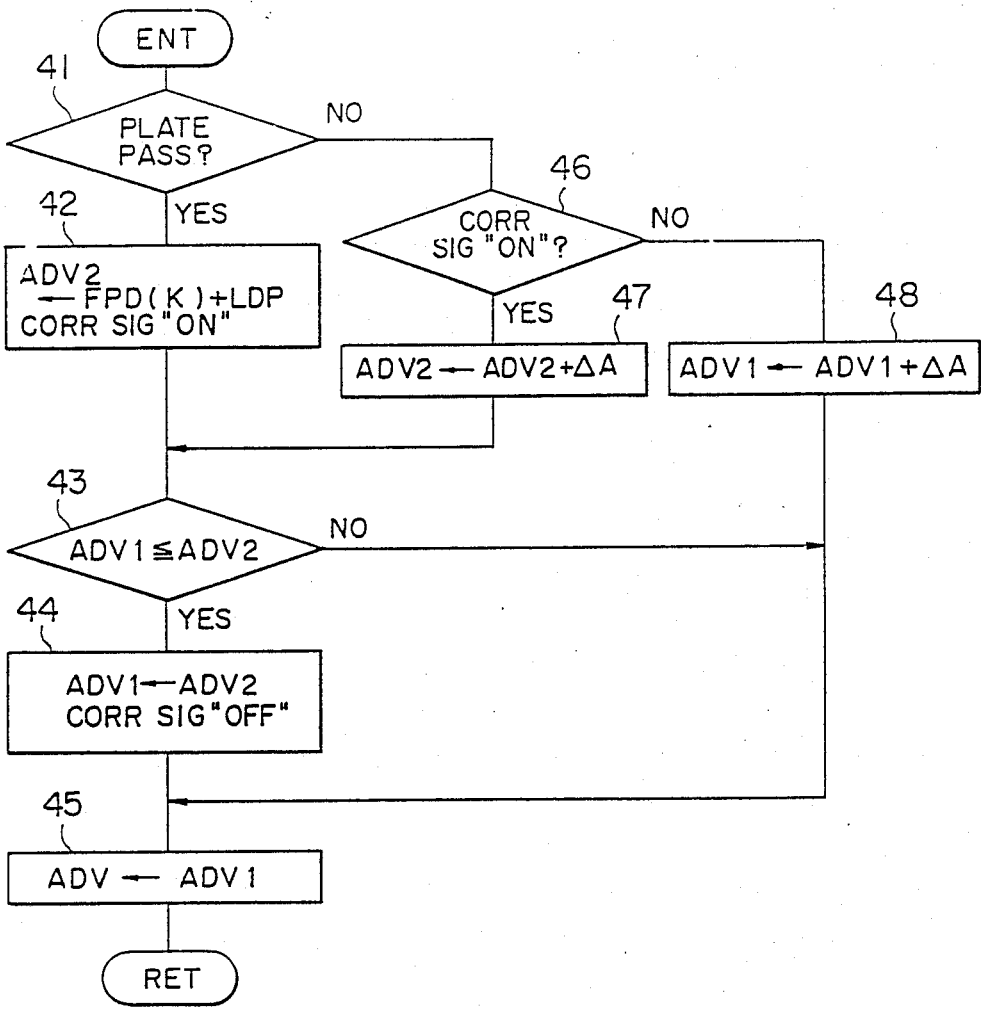
FIG. 4 is a flow chart for explaining the entire operation of this embodiment.

The calculation of the advance position during predetermined running of the cage will be described in more detail with reference to FIG. 4.

It will be assumed that the cage is running from the first floor to the second floor, and the cage position detector has not yet engaged with the plate installed in the vicinity of the second floor in the elevator shaft. Therefore, plate passage information is not output in step 41. Then, the flow advances to step 46, in which it is determined whether or not the correction signal is "ON". Since plate passage has yet to occur, the correction signal is not "ON". So, the flow advances to step 48, in which a preset time-dependent increment ΔA is added to the time-dependent advance position ADV1 which is set to an initial value, thereby updating the advance position. The real advance position ADV is then set to the advance position ADV1 in step 45. In step 41 of the next advance position calculating period, it is again determined whether the cage has passed the plate. If it is determined that the cage has passed the plate, a corrected advance position ADV2 is obtained by the calculation ADV 2 FPD←(K)+LDP to correct the time-dependent advance position ADV1 in step 42, and the correction signal is set to "ON". Thereafter, ADV1 is not calculated while the correction signal is "ON" (as determined in step 46), ΔA is added only to ADV2 (in step 47), and ADV1 is compared in magnitude with ADV2 in step 43. When ADV2 is smaller than ADV1, the unchanged value of ADV1 is used as ADV in step 45. When ADV2 becomes larger than ADV1, the correction signal is turned "OFF" in step 44, ADV1 is set equal to ADV2, and this value of ADV2 is used as ADV. When the correction signal becomes "OFF", the flow is returned to the normal calculation of the advance position (in steps 48 and 45).

More specifically, when the correction signal is "OFF", ADV1 is calculated to obtain ADV. When plate passage takes place, the value of ADV2 is set, and the correction signal is turned "ON". When the correction signal is "ON", ADV1 is not calculated, only ADV2 is calculated, and ADV is not advanced until ADV2 exceeds ADV1. In this manner, the advance position is corrected.

Figure 5:
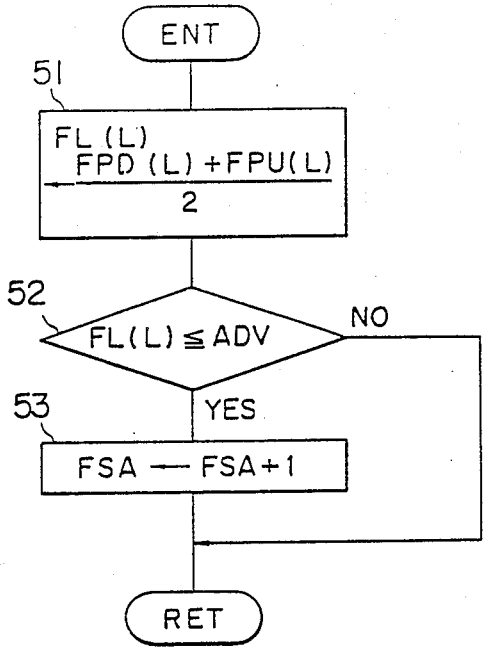
FIG. 5 is a flow chart for explaining a method of correcting the advance floor.
Figure 6:
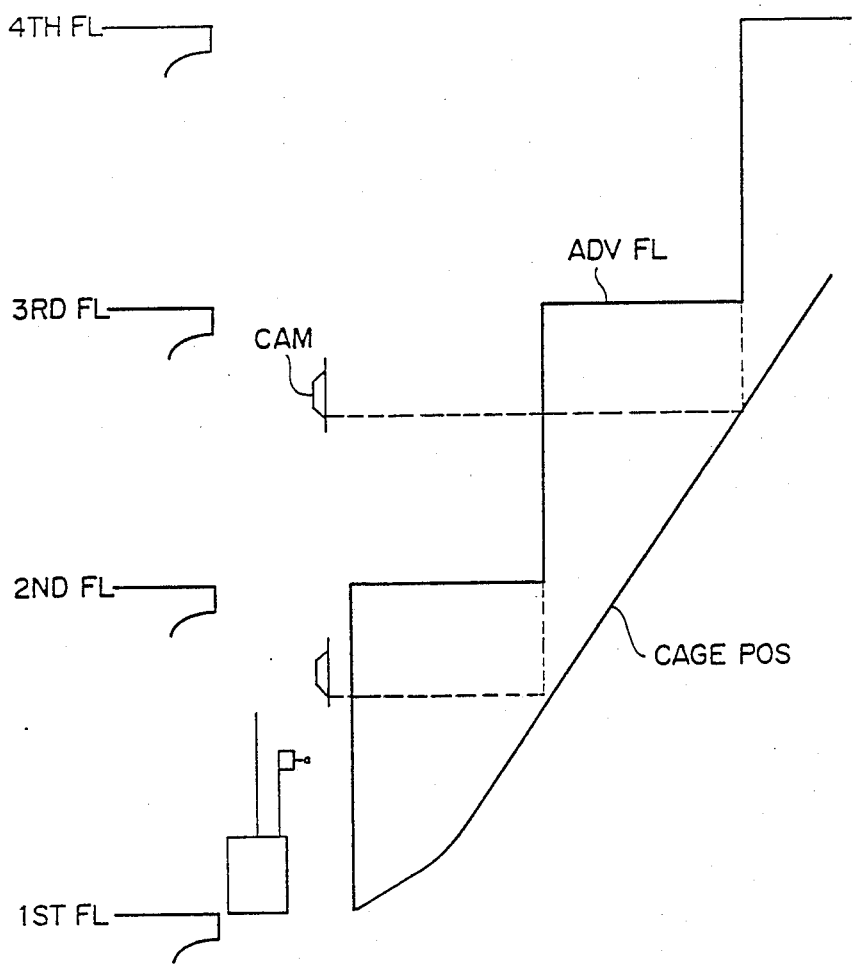
FIG. 6 PRIOR ART
FIG. 6 is a view showing the relationship between a cage position and an advance floor in a conventional apparatus.

An advance floor FSA is obtained in accordance with the advance position ADV obtained as described above. It will be assumed that the advance floor is the Lth floor. The level FL(L) of the Lth floor is represented by the plate positions FPD(L), FPU(L) on the Lth floor. FL(L) is obtained in step 51 of FIG. 5, and FL(L) is compared with ADV in step 52. When ADV becomes greater than or equal to FL(L), it is determined that the advance position exceeds the Lth floor level. FSA is set equal to FSA+1 in step 53, and the advance floor is set to the (L+1)th floor. Thus, the advance position is compared with the level of the advance floor, thereby updating the advance floor.

The calculation of the advance for upwards running of the cage has been described. This calculation is similar for downwards running of the cage.

The selection of the operating mode will be described. It is determined whether the cage is at full speed or partial speed according to whether the running distance of the cage is the full speed runnable distance or more. Therefore, when a passenger requests a stop at a stoppable floor at a full speed runnable distance or less during acceleration of the cage, the cage is set to partial speed running when the advance position reaches the requested stopping position, and set to full speed running at other times.

Because the calculation of the advance is performed as described above, the apparatus of the present invention for controlling an elevator provides the following features.

(1) The cage can operate in a mode which is optimal for its running distance.

(2) Since the advance can be calculated irrespective of the number of floors and the interfloor distances, the ROM for storing the interfloor codes is eliminated.

(3) Since the calculation of the advance is performed by utilizing plates already installed in the elevator shaft for indicating time and detecting the door openable zone or the level position and the position detector provided in the cage, new components are not required.

According to the present invention as described above, the time-dependent cage advance position is calculated according to the cage running time irrespective of the interfloor distances when the cage advance floor is detected, and the cage advance floor is detected. Therefore, a particular arrangement is not required even in buildings having different interfloor distances, and since the advance floor can be obtained by the reference processing, an apparatus for controlling the elevator with very high universality can be provided.

What is claimed is:

1. An apparatus for controlling an elevator comprising:

a plate provided before a cage stopping position of each floor in an elevator shaft;

plate passage detecting means for outputting a position signal when the cage passes each plate;

a memory for storing position information of plates to be read in accordance with said position signals;

advance position calculating means for calculating a time-dependent advance position based on the elapsed time since the separation of the elevator cage from a stopping floor;

advance position correcting means for correcting the time-dependent advance position in accordance with the plate position information read from said memory when said position signal is output to obtain a real advance position; and advance floor calculating means for comparing the real advance position with the plate position information to produce a cage advance floor.

2. The apparatus according to claim 1, wherein said advancing position calculating means adds a cage moving distance responsive to the lapse of a time from the separation of the cage from a stopping floor to the advancing position already determined at the time of stopping the cage to determine the advancing position.

3. The apparatus according to claim 2, wherein the moving distance of the cage is obtained at a constant speed running time by:

a rated speed × running time as a reference.

4. The apparatus according to claim 2, wherein the moving distance of the cage is obtained at an acceleration running time by:

(distance necessary to be able to run at full speed/-(time from start to end of acceleration) × time as a reference.

5. An elevator control apparatus comprising:

a plurality of plates mounted in an elevator shaft;

a sensor mounted on an elevator car for detecting the passage of the elevator car past the plates;

advance position calculating means for calculating a time-dependent advance position based on the length of time since the sensor last detected the passage of the elevator past one of the plates and the speed of the elevator car, the advance position signal being equal to or advanced from the maximum possible advance position of the elevator car when the elevator is running at rated speed; and correcting means for correcting the time-dependent advance position to an actual advance position each time the sensor detects the passage of the elevator car past one of the plates.

6. A control apparatus as claimed in claim 5 wherein the advance position calculating means comprises means for calculating an advance position equal to the actual advance position when the sensor last detected the passage of one of the plates plus an integral with respect to time of the rated speed of the elevator plus a margin.

7. A control apparatus as claimed in claim 5 wherein the correcting means comprises means for setting the time-dependent advance position equal to the position of the most recently detected plate in the elevator shaft plus a deceleration distance.

8. An elevator control apparatus comprising:

a plurality of plates mounted in an elevator shaft;

a sensor mounted on an elevator car for detecting the passage of the elevator car past the plates;

advance position calculating means for calculating a time-dependent advance position of the elevator car equal to the actual advance position of the elevator car when the sensor last detected the passage of the elevator car past one of the plates plus the integral of the rated speed of the elevator from the time since the sensor last detected the passage of the elevator car past one of the plates plus a margin;

correcting means for correcting the time-dependent advance position to equal the position of one of the plates detected by the sensor plus a deceleration distance; and advance floor calculating means for calculating an advance floor based on the time-dependent advance position.

* * * * *

UNITED STATES PATENT AND TRADEMARK OFFICE

CERTIFICATE OF CORRECTION

PATENT NO. : 4,984,660

DATED : January 15, 1991

INVENTOR(S) : Ikejima et al.

It is certified that error appears in the above-identified patent and that said Letters Patent is hereby corrected as shown below:

TITLE PAGE:

In item [57] Abstract, line 3, change "time" to --times--.

Column 7, line 23, after "speed" insert --)--;
" 7, line 33, after "elevator" insert --car--.

Signed and Sealed this

Twenty-eighth Day of July, 1992

*Attest:*

DOUGLAS B. COMER

*Attesting Officer*

*Acting Commissioner of Patents and Trademarks*